United States Patent [19]

Sharp

[11] 4,055,127

[45] Oct. 25, 1977

[54] HEM FOLDING ATTACHMENT

[75] Inventor: James E. Sharp, Economy, Ind.

[73] Assignee: Union Special Corporation, Chicago, Ill.

[21] Appl. No.: 666,386

[22] Filed: Mar. 12, 1976

[51] Int. Cl.[2] ..... D05B 35/04

[52] U.S. Cl. ..... 112/143

[58] Field of Search ..... 112/141, 143, 144, 147, 112/174, 136, 153

[56] References Cited

U.S. PATENT DOCUMENTS

| | | | |
|---|---|---|---|
| 96,180 | 10/1869 | Yentzer | 112/141 |
| 3,192,885 | 7/1965 | Timm | 112/143 X |
| 3,277,851 | 10/1966 | Dobner et al. | 112/141 X |
| 3,752,100 | 8/1973 | Sharp | 112/143 |
| 3,786,768 | 1/1974 | Kosrow et al. | 112/143 |

*Primary Examiner*—Werner H. Schroeder
*Assistant Examiner*—Peter Nerbun
*Attorney, Agent, or Firm*—John W. Harbst; John A. Schaerli

[57] ABSTRACT

A hem folding attachment for forming an S-shaped fold in the edge of a flexible sheet prior to the stitching of the folded edge by a sewing machine. The attachment includes first and second movable guides cooperably associated for forming the fold on the workpiece. The first movable guide has integrally formed thereon a hem fold control finger portion which extends parallel to the direction of feed and is interposed within the fold for effecting the movement of the fold to the sewing machine. The hem fold control finger portion is positioned within a cutout located on the top side of the throat plate whereas to maintain the presser foot in its normal operating position during the sewing operation.

10 Claims, 9 Drawing Figures

FIG. 3
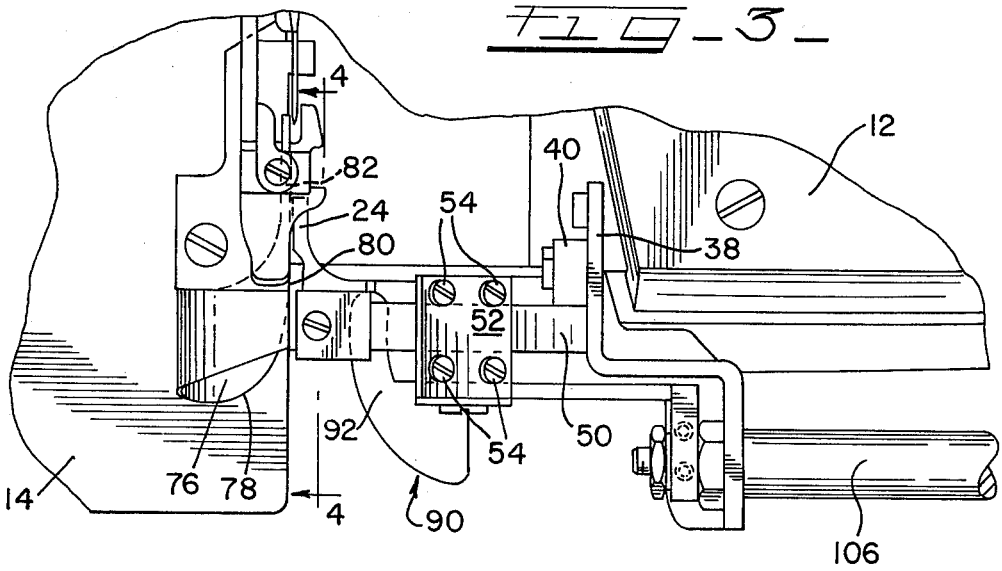
FIG. 4
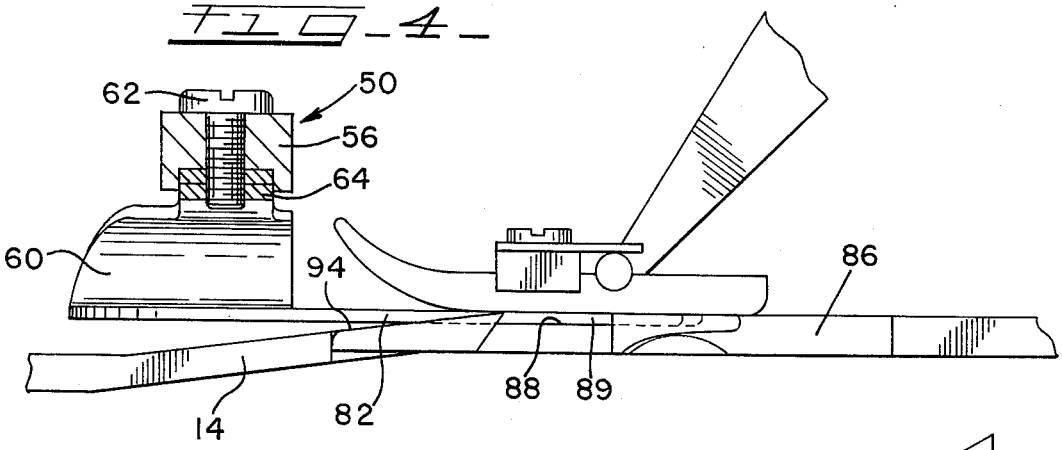
FIG. 7
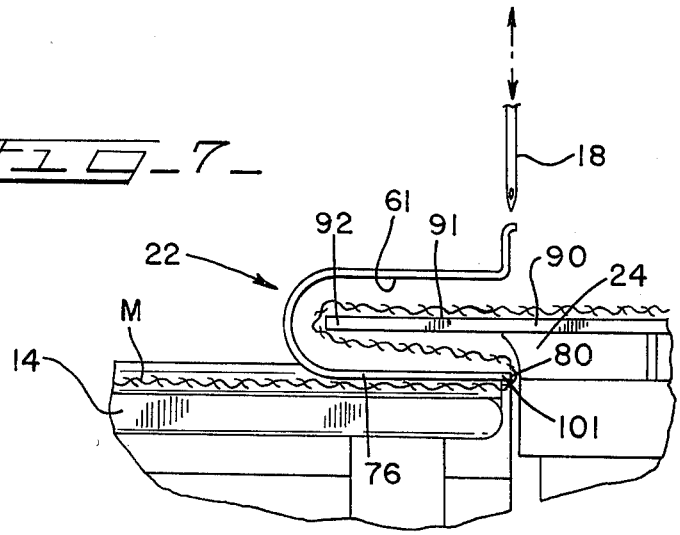
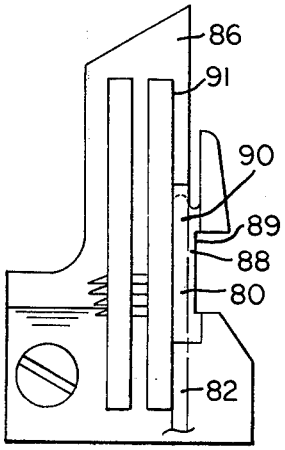
FIG. 9

HEM FOLDING ATTACHMENT

This invention relates in general to improvements in attachments for sewing machines, and more particularly to a hem folding attachment.

BACKGROUND OF THE INVENTION

This invention represents an improvement over such apparatus as disclosed in U.S. Pat. No. 3,752,100 issued Aug. 14, 1973 to J. E. Sharp.

Some of the hemming attachments heretofore known, as well as the device disclosed in the above mentioned U.S. Patent utilize two movable folder sections for forming a blindstitch type hem. In devices of this sort, the folders move between an operative position and a closed position whereby the material to be hemmed may be readily positioned within the folding attachment. Devices of this sort have certain drawbacks. One of the drawbacks incurred in using this type device is that once the fold exits the rear of the folder assembly the remaining longitudinal movement of the folded sheet to the stitch forming mechanism is undirected thereby enabling the folded sheet to move or pull away from the stitch forming mechanism for whatever reason, and therefore a decrease in the quality of a blindstitch hem produced will result.

SUMMARY OF THE INVENTION

In view of the foregoing, and in accordance with the present invention there has been developed a hem folding attachment which provides the means for folding the edge of a flexible sheet prior to the stitching of the folded edge by a sewing machine stitch forming mechanism. The present invention also provides a finger portion which is integrally formed as part of the guide portion. The finger portion is designed so as to be interposed within the fold once the fold has been fabricated by the folder assemblies.

The finger portion rearwardly projects from the hem folder in a straight or parallel relationship with the end of the clothplate and extends towards and slightly to the left of the needle terminating at a point just beyond said needle. The provision of this finger keeps the S-shaped fold in the material from pulling away from the needle and therefore will increase the quality of the blindstitch produced.

The present invention is comprised of first and second movable guide means which operate between a first open position and a second closed or normal working position. Upon operation of the device the guide means are forceably moved into position wherein the second guide means extends into the first guide means and cooperates therewith so as to form an S-shaped fold in the edge of the sheet being worked upon. A hem fold control finger means is provided for effecting the movement of the S-shaped fold as it exits the rear of the folder assembly and guides the same into very close proximity with the stitch forming mechanism of the sewing machine. The throat plate associated with the machine is provided with a groove on its top side. Once the folders arrive at their normal operating position the hem fold control finger is positioned within the groove. By the provision of this groove the presser foot assembly is capable of attaining its normal working position, that is, the presser foot remains in working contact with the top of the sewing machine throat plate and is not displaced by the hem fold control finger means thereby insuring a positive feeding action.

In view of the foregoing, the present invention has for an object to provide a hem folding attachment for sewing machines which produces an S-shaped fold in the edge of a flexible sheet prior to the stiching of the folded edge by a sewing machine.

Another object of the invention is to provide a movable hem guide which has associated therewith a finger means for effecting movement of the S-shaped fold from the folding apparatus to a point which is in close proximity with the stitch forming mechanism.

Yet another object of the invention is to provide the means which cooperate with the guide means in keeping the presser mechanism in its normal working position.

Yet another object of the invention is to provide first and second movable guides each mounted for movement between an operative position and a closed position whereby material to be hemmed may be readily positioned within the folding attachment.

With the above and other objects in view that will hereinafter appear, the nature of the invention will be more clearly understood by reference to the following detailed description, the appended claims and the several views illustrated in the accompanying drawing.

BRIEF DESCRIPTION OF THE DRAWINGS

FIG. 3 is a fragmentary plan view of a portion of the sewing machine of FIG. 1 and shows specifically the details of the hem folder and the relationship thereof to other components of the sewing machine.

FIG. 4 is an enlarged vertical sectional view taken along the line 4—4 of FIG. 3.

FIG. 7 is an enlarged elevational view showing the relationship of the hem folding attachment with respect to a cloth plate and a needle of a sewing machine and shows the specific position of material therein folded ready for stitching.

FIG. 9 is a partial top plan view of the throat plate of this invention.

Figure 1:
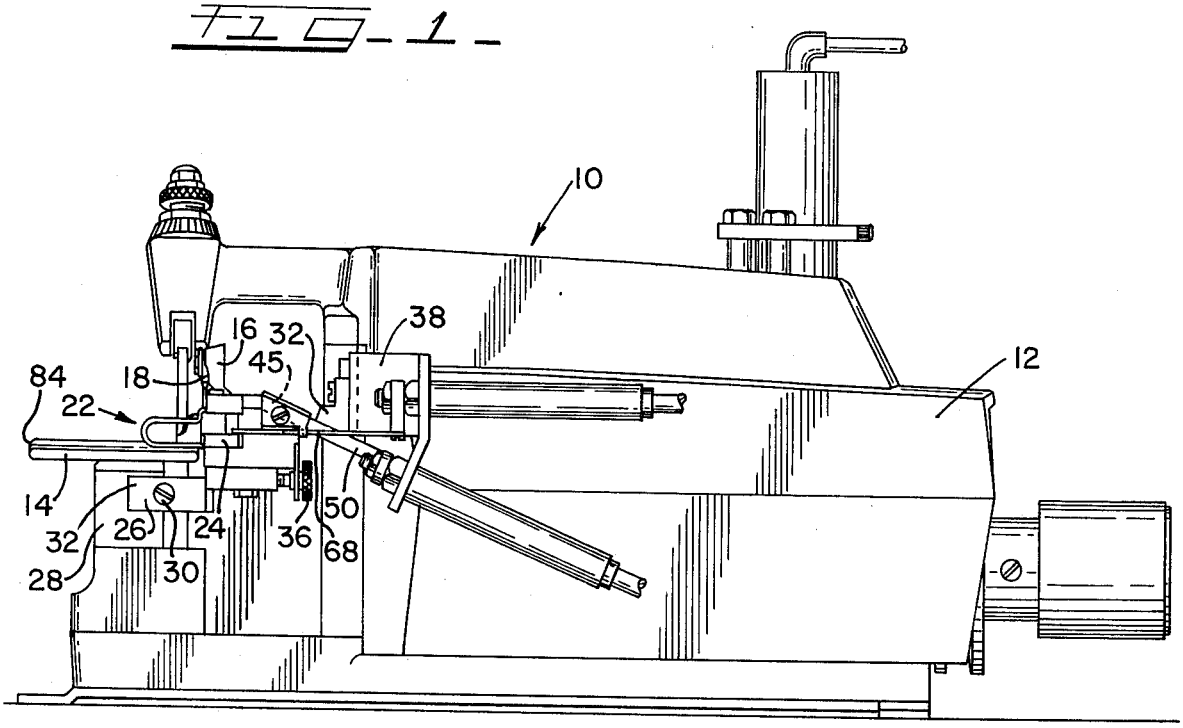
FIG. 1 is a front elevational view of a sewing machine incorporatinng a hem folder.
Figure 2:
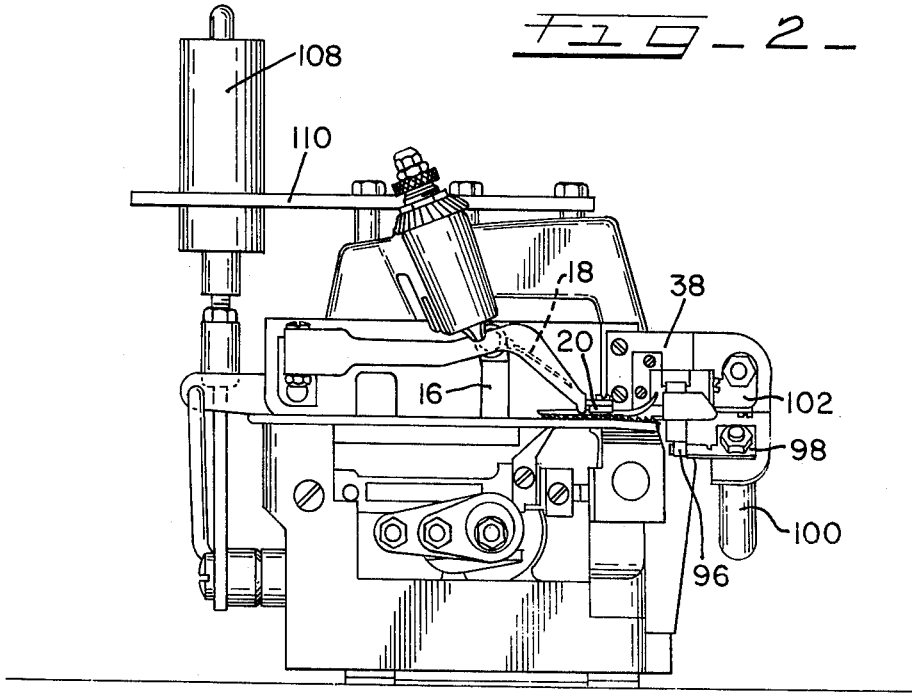
FIG. 2 is an end elevational view of the sewing machine and hem folding attachment of FIG. 1.

Referring now to the drawings in detail, it will be seen that there is illustrated in FIG. 1 a conventional sewing machine which is generally identified by the numeral 10 and for descriptive purposes, may be considered to be of the type disclosed in U.S. Pat. No. 2,704,042 to Wallenberg et al., granted Mar. 15, 1955. The sewing machine 10 includes a frame 12 which has mounted thereon in the customary manner a cloth plate 14, a needle arm 16, which supports a needle 18, and a presser foot 20 (FIG. 2).

Figure 5:
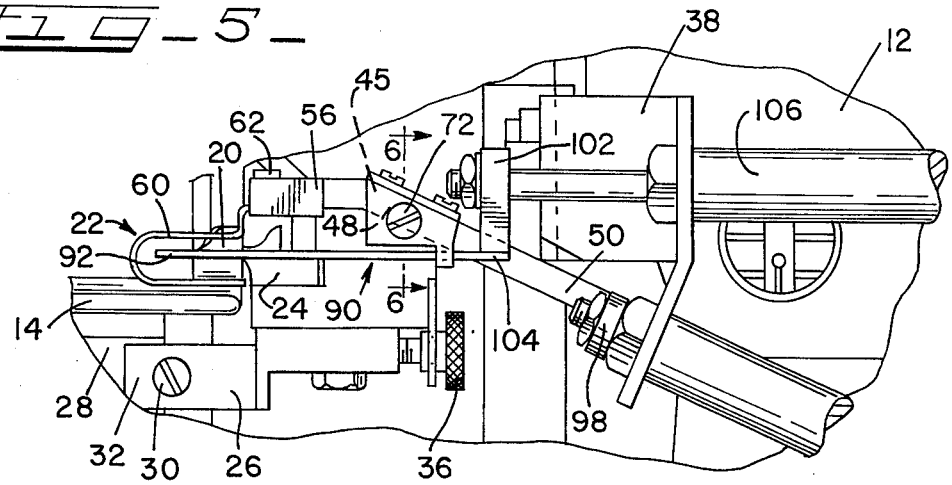
FIG. 5 shows the hem folder in its normal working position.
Figure 6:
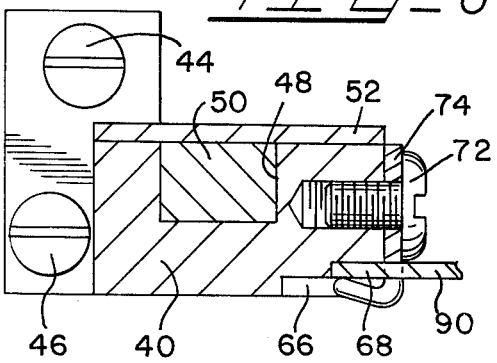
FIG. 6 is a view taken along the line 6—6 of FIG. 5.

In accordance with the invention and as may be best viewed in FIGS. 1 and 5 there is mounted on the frame 12, in association with the cloth plate 14, a material folder assembly, generally identified by the numeral 22. The material folder assembly 22 is positioned for folding material in advance of its longitudinal movement beneath the presser foot 20 for the sewing thereof by the needle 18. This specifically illustrated material folder assembly is a hem folder, and the sewing machine 10 is an overedge sewing machine equipped to produce a blindstitch hem. This is the preferred embodiment for use of the invention, but it is to be understood that the principles of the folder construction are not restricted to one utilized in a blindstitch hemming operation, and the configuration of the material folding sections, to be described hereinafter, may be varied in accordance with the particular requirement of a flexible sheet folding operation.

Folder assembly 22 associates with an adjustable hemming guide attachment 24 which is carried on a support bracket 26. The support bracket 26 is fixedly secured to a knife support block 28 on the sewing machine 10. A screw 30 carried by the support bracket 26 extends through the first end means 32 of bracket 26 and is threadable into a threaded bore (not shown) in the knife support block 28 to rigidly, yet removably, mount the support bracket 26. The adjustable edge guide 24 is adjusted in the normal manner, that is, by turning the knurled adjusting screw 36, the edge guide 24 is moved either left or right so that the edge guide presents the folded edge of the sheet to the stitching mechanism thereby enabling the stitches produced to be located in the folded edge. The edge guide is adjustable as mentioned above, but it should also be pointed out that the edge guide is spring pressed to compensate for the difference in material thickness, the advantages of which will be pointed out hereinafter.

As may be best viewed in FIGS. 1, 2, 3 and 6 there is provided a generally S-shaped mounting bracket 38 secured to the frame 12 in a conventional manner. A stepped bracket 40 is secured at its first end means 32 to the mounting bracket 38 by screw means 44 and 46. The stepped bracket 40 has at its second end means 45 an elevated portion which has an oblique upper surface which is provided with a groove 48 in which there is received in a sliding relationship, a slide member 50. The slide member 50 is slidably retained within the groove 48 by means of a coverplate 52 which is secured to the bracket 40 by a plurality of suitable fasteners 54. As may be best viewed in FIGS. 1 and 6, the stepped bracket 40 has formed in the underside thereof, a groove 66 which receives therein for sliding movement, an arm portion 68 of the second guide member 90. Fixedly secured by screw means 72 to the bracket 40 is a generally J-shaped support member 74, the lower end of which horizontally supports the arm portion 68 of the second guide member 90.

As may be best viewed in FIGS. 4 and 5, the slide member 50 has provided at its first end means 56 a horizontal widened end mounting portion wherein the first movable guide means 60 is adjustably secured. Screw means 62 serves to rigidly secure the mounting portion 64 of the first guide means 60 to the slide member 50.

Drawing attention now to FIGS. 1, 3, 4 and 5, it is to be noted that the first movable guide means 60 is generally U-shaped in elevation and includes a lower blade 76 which is generally parallel to the clothplate 14. The forward portion 78 of the lower blade 76 is curved as is best shown in FIG. 3. This curved portion 78 radially extends rearwardly in a direction towards the needle and extends in such direction until it tangentially meets with a rearwardly extending edge 80. This edge 80 forms the right extremity of a rearwardly extending hem fold control finger 82. The finger portion 82 is designed so as to be interposed within the lower fold of the fabric formed by the blade 76 once the S-shaped fold has been fabricated by the folder assembly 22. It should be pointed out that the entire edge 80 of the finger portion 82 projects from the blade portion 76 in a direction such that there is a straight or parallel relationship set between the entire edge 80 and the left extremity 84 of the clothplate 14. A parallel relationship also exists between the edge 80 and the guiding edge of the adjustable guide 24. The finger portion 82 extends rearwardly toward and slightly to the left of the needle 18, terminating at a point just beyond said needle.

The purpose of the finger 82 is to cooperate with the yielding guide 24 and thereby provide the means for effectively guiding the longitudinal movement of the S-shaped fold between the point where it exits the rear of the folder assembly 22 up to a point which is in close proximity with the needle 18. The provision of this means prevents the S-shaped fold from uncurling or pulling away from the needle and the stationary guide 24. The yielding adjustable guide 24 is designed so as to yield or slightly move when the thickened part or seam of the sheet to be sewn is fed to the stitching mechanism. In this manner the line of stitching produced thereby is of equal depth in single thickness as of the cloth as well as a thickened part. In this manner both the first and second movable guide means are allowed to remain in their fixed normal operating positions during the hemming operation and do not have to be moved to allow for seams or thicknesses in the sheet.

As best indicated in FIGS. 4 and 9, the throat plate 86 is provided with a groove or cutaway portion. As best seen in FIG. 9, groove 88 extends in a lateral direction from side means 89 in the throat plate means 86 to the feed dog slot means 91. The groove 88 is cut lengthwise to the top surface of the throat plate 86. This cut 88 provides space for the rearwardly extending portion 90 of the hem fold control finger 82 so as to not raise the presser foot from its standard operative position. The throat plate is also slanted as indicated at 94 to conform with the design of the slanted clothplate 14. In all other respects the presser foot 20 and the throatplate 86 are constructed in the usual manner. As mentioned earlier by the provision of the cut or groove 88 the presser foot 20 is enabled to cooperate with the feeding action of the sewing machine in the normal manner. That is to say, the rearwardly extending portion 89 of the hem fold control finger 82 does not interfere with the feeding action of the sewing machine.

The second guiding member 90 has its first end means 92 forceably moved into the first guiding means 60 upon its actuation. The first end means 92 of the second movable guide member 90 terminates in a curved tongue portion 93 which is best shown in FIG. 3. It is to be understood that the material being folded within the folder section 60 will be folded around this curved portion 93.

In order to facilitate the insertion and removal of the material from the folder assembly 22, the first and second movable guide members 60 and 90 are movable in generally opposite directions. In order to facilitate this movement, the slide member 50 is pivotally connected at its second or lower terminal end 96 (FIG. 2) to a link member 98 which serves to connect an extensible fluid cylinder means 100 to the slide member 50 for effecting movement thereof. A somewhat similar link 102 is connected to the second end means 104 of the second movable guide member and serves the purpose of connecting a second extensible air cylinder means 106 to effect movement of the guide member 90 into its normal working position as shown in FIG. 5. It is to be understood that the cylinders which are fixedly secured to the member 38 may be moved in any practical manner in order to effect the opening and closing of the folder assembly 22.

As may be best seen in FIG. 2, there is shown in conjunction with the sewing machine 10, a presser foot lifting air cylinder 108 which is carried by a support bracket 110 mounted on the top cover of the sewing machine 10. The cylinder 108 is of a conventional construction and is conventionally connected to the presser foot lifter mechanism of the sewing machine 10 operating the same.

Figure 8:
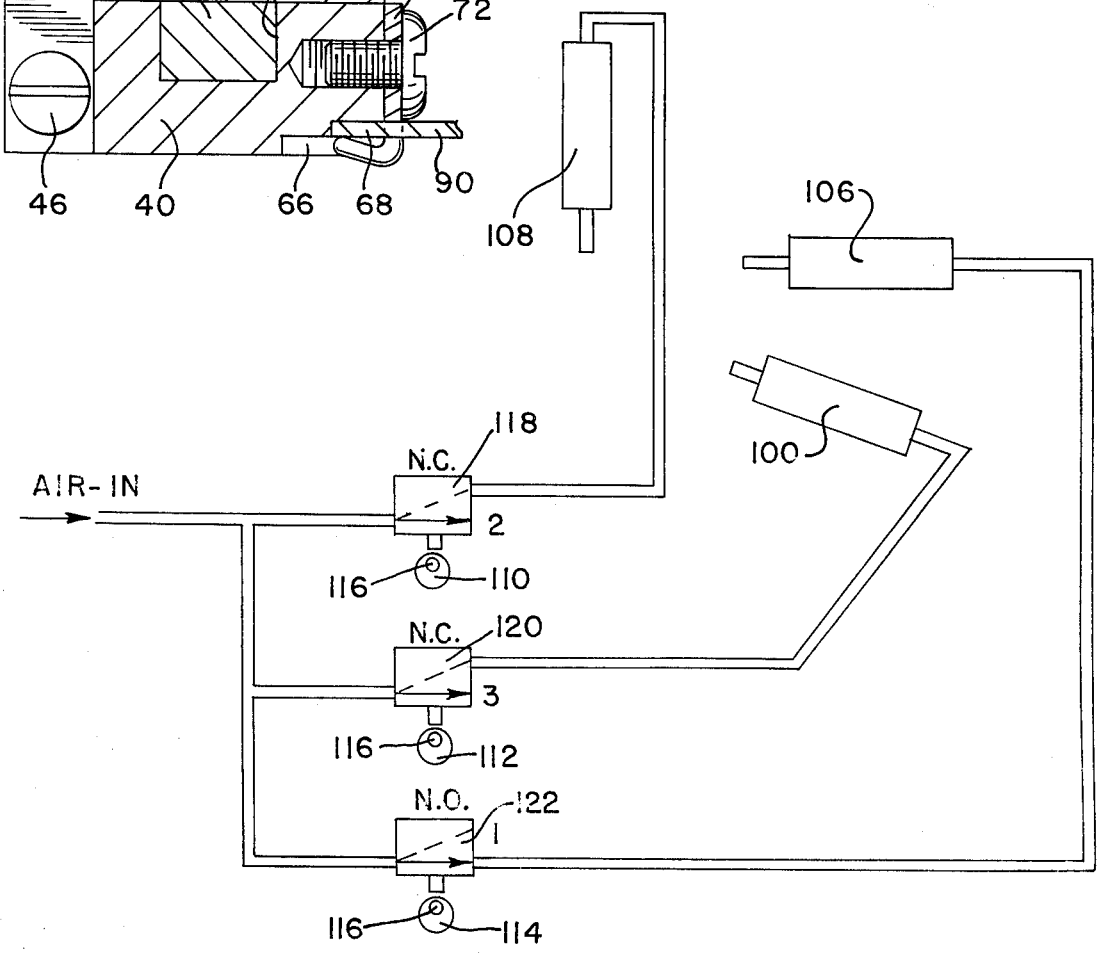
FIG. 8 is a schematic diagram of the pneumatic control system for the hem folding attachment.

The sewing machine 10 has associated therewith a control mechanism for successively operating the plurality of air cylinders mentioned above. The control mechanism is of the type that is generally shown in U.S. Pat. No. 3,245,369 to G. Myska, issued Apr. 12, 1966. In viewing FIG. 8, it will be seen that a device of this sort utilizes a plurality of cams 110, 112 and 114 which are arranged on a common rod 116 for actuating each of three air switches 118, 120 and 122 in timed relationship. As shown in the above mentioned patent, the cams are actuated by the operator through a knee press or other suitable means. The cams are adjusted on the rod to operate the air cylinders so that the retraction of the second movable guide means 90, the raising of the presser foot 20 and the extension of the first movable guide 60 occur in sequence. This particular sequence would take place at the end of a hemming operation.

OPERATION

In particular reference to FIG. 7, it will be seen that the material M which is to be hemmed is principally supported by the clothplate 14 and has the marginal portion thereof feeding through the folder assembly 22. The marginal portion of the material is first reversely folded about the edge 101 of the blade 76 of the first movable guide member 60 in conjunction with the edge guide means 24. The marginal portion of the material is then reversely folded about the tongue 92 of the second movable guide means 90 and extends in the space between the upper surface 91 of the second guide means 90 and the upper part 61 of the first guide means 60.

It is to be noted that the first reverse fold of the material hem, that is the fold about the edge portion 80 is generally aligned with the needle 18. On the other hand, the extreme marginal edge of the material extends to the right as viewed in FIG. 7, beyond this fold, the sewing machine 20 may be equipped with a knife (not shown) which will trim the extra material before the necessary stitching has been effected.

For the sake of explanation, let it now be assumed that there is a workpiece positioned within the folder assembly so as to form an S-shaped fold in the extremity of the workpiece. In comparing FIGS. 3 and 7, it may be seen that by the provision of the finger 82 having an edge 80 which runs parallel to the direction of feed as well as extending to a point in close proximity of the needle, the first or lower fold in the edge is maintained in alignment with the needle so as to insure needle penetration in the edge of the garment so as to form a good blindstitch hem. In viewing FIG. 9 it should be apparent the finger 82 draws only the extreme edge of the garment into the groove and passes or guides same under the presser foot while the remainder of the garment is advanced by the feed mechanism over the top surface of the throat plate in the usual manner whereby drawing the garment edge in the groove 88 through the stitching mechanism. Without such provision it may be seen that the remaining lateral movement of the sheet, that is the movement from the back of the first folder as viewed in FIG. 3 to the needle would allow the fold in the fabric to be undone or such unguided movement to the needle may end up by the sheet pulling away from the stitching area thereby forming a faulty hem. It should also be noted the provision of the cutout in the top of the sewing machine throat plate allows the finger portion of the first folder means to sit in said recess whereby allowing the presser foot to remain in its normal working position with the top of the throat plate. Without such cutout the presser foot would be caused to ride on the top of said finger whereby the feeding action, that is the combined motion of the feed dogs with the lower portion of the presser foot would be detrimented because of the finger portion causing the foot to ride above its normal working position.

Thus, it is apparent that there has been provided, in accordance with the invention, a hem folder attachment that fully satisfies the objects, aims, and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. An apparatus for folding the edge of a flexible sheet prior to the stitching of the folded edge by a stitch forming mechanism, said apparatus comprising:

first movable guide means having a folding portion means;

second movable guide means; a stitch forming mechanism;

actuation means connected to said guide means for effecting movement of said guide means wherein said second guide means cooperably associates with said first guide means to effect folding of an edge portion of said sheet to form an S-shaped fold in said edge; and finger portion means associated with said first movable guide means, being interposed within said fold and having a rearwardly extending guiding edge which is generally parallel to the line of feed in front of said stitch forming mechanism for urging said sheet against said stitch forming mechanism.

2. An apparatus according to claim 1 wherein said first and second guide means are so arranged as to form a blindstitch hem fold.

3. An apparatus according to claim 1 wherein said finger portion means extends in the direction of feed from said folding portion means to a point adjacent the stitch forming area.

4. A hem folding attachment in combination with an overedge sewing machine having a needle, a looper, a presser foot, a feeding mechanism for feeding a flexible sheet to said needle, an adjustable guide means having a yielding guiding edge, said hem folding attachment comprising:

a support means;

a first movable folder means having a hem fold control means;

a second movable folder means overlying said support means;

mounting means for mounting said movable folder means relative said needle;

actuation means connected to said folder means for moving said folder means in a cooperative relationship for forming an S-shaped fold in an edge of said flexible sheet; and said hem fold control means being interposed within said fold for urging said fold against said needle, said control means having a guiding edge parallel to said adjustable guide's guiding edge.

5. The hem folding attachment of claim 4 wherein said support means is comprised of:

cloth plate means having a material engaging surface; and a throat plate means having a groove on its top side for receiving said hem fold control means.

6. The hem folding attachment of claim 5 wherein said groove is arranged lengthwise of said throat plate.

7. The hem folding attachment of claim 4 wherein said actuating means is comprised of a plurality of pneumatically operated cylinders.

8. The hem folding attachment of claim 4 wherein movement of said second movable folder means is in a plane substantially parallel to said support means.

9. The hem folding attachment of claim 4 wherein said mounting means include means for separately guiding each of said folder means.

10. The hem folding attachment of claim 4 wherein said first folder is mounted for transverse movement; and said second folder is mounted for generally straight line movement.

* * * * *